US007886923B2

(12) United States Patent
Nakada et al.

(10) Patent No.: US 7,886,923 B2
(45) Date of Patent: Feb. 15, 2011

(54) CONTAINER STOPPER WITH SYNTHETIC RESIN SKIN

(75) Inventors: Takiko Nakada, Osaka (JP); Toshihiro Ueda, Osaka (JP); Hirofumi Fujiwara, Okayama (JP); Katsuya Fujimoto, Okayama (JP)

(73) Assignees: Suntory Holdings Limited, Osaka (JP); Uchiyama Mfg. Corp., Okayama (JP)

( * ) Notice: Subject to any disclaimer, the term of this patent is extended or adjusted under 35 U.S.C. 154(b) by 1453 days.

(21) Appl. No.: 10/525,914

(22) PCT Filed: Aug. 26, 2003

(86) PCT No.: PCT/JP03/10806

§ 371 (c)(1),
(2), (4) Date: Oct. 24, 2005

(87) PCT Pub. No.: WO2004/020300

PCT Pub. Date: Mar. 11, 2004

(65) Prior Publication Data

US 2006/0151424 A1 Jul. 13, 2006

(30) Foreign Application Priority Data

Aug. 30, 2002 (JP) ..... 2002-255614

(51) Int. Cl.
*B65D 39/00* (2006.01)
*B65D 41/00* (2006.01)
*B65D 43/04* (2006.01)

(52) U.S. Cl. ..... 215/364; 215/355; 215/354; 220/801

(58) Field of Classification Search ..... 215/355, 215/364; 428/66.3, 35.7; 264/35.5; 220/801
See application file for complete search history.

(56) References Cited

U.S. PATENT DOCUMENTS

| | | | | |
|---|---|---|---|---|
| 2,649,090 | A * | 8/1953 | Parsons et al. | 604/415 |
| 3,760,969 | A * | 9/1973 | Shimamoto et al. | 215/247 |
| 4,635,807 | A * | 1/1987 | Knapp | 215/247 |
| 6,153,275 | A * | 11/2000 | Yaniger | 428/34.4 |
| 2007/0272650 | A1 * | 11/2007 | Kishi et al. | 215/364 |

FOREIGN PATENT DOCUMENTS

| | | |
|---|---|---|
| EP | 0450096 A1 | 10/1991 |
| EP | 0532367 A2 | 3/1993 |
| FR | 1022562 | 3/1953 |
| FR | 1025862 | 4/1953 |

(Continued)

*Primary Examiner*—Robin Hylton
(74) *Attorney, Agent, or Firm*—The Webb Law Firm

(57) ABSTRACT

A container stopper, and a manufacturing method therefor, capable of reliably preventing adverse influences of various smells entering from outside the container and absorption and adsorption of the flavor of the contents, as well as preventing adverse influences of a core such as cork. The container stopper comprising a core formed of an elastic material and having a liquid-contact surface and an outer peripheral surface continuous with the liquid-contact surface coated with a skin made of a synthetic resin, and the manufacturing method therefor. In the container stopper, the skin is made of a polyester resin or a synthetic resin having a polyester resin as a main component thereof, and the skin is bonded to the liquid-contact surface and the outer peripheral surface of the core through a bonding layer.

14 Claims, 5 Drawing Sheets

FOREIGN PATENT DOCUMENTS

| | | |
|---|---|---|
| JP | 004292/1983 | 7/1984 |
| JP | 099515/1984 | 1/1986 |
| JP | 179246/1986 | 4/1988 |
| JP | 5124665 | 5/1993 |
| JP | 2000079953 | 3/2000 |
| JP | 2001161790 | 6/2001 |
| WO | 03004367 A1 | 1/2003 |

* cited by examiner

CONTAINER STOPPER WITH SYNTHETIC RESIN SKIN

BACKGROUND OF THE INVENTION

1. Field of the Invention

The present invention relates to a container stopper, and a manufacturing method therefor, in which a liquid-contact surface and an outer peripheral surface continuous with the liquid-contact surface of a core formed of an elastic material are coated with a synthetic resin skin.

2. Description of Related Art

As stoppers used for containers of whiskey and wine, for example, compressed cork stoppers, which are formed by blending an adhesive to cork grain made to an appropriate grain size, then heating and pressurizing it to form a compressed cork plate or compressed cork material, and punching or cutting it to a desired shape, and natural cork stoppers, are widely used conventionally.

However, with the conventional cork stoppers, although surface treatment is done with wax, silicone oil or the like, the cork is in a bare state. Therefore, when the cork is contaminated by mold smelling substances, typically trichloro-anisole (TCA), they could diffuse into the whiskey or wine in the containers to spoil the taste of the contents. In addition, cork dust could fall into the contents.

Furthermore, the contents could soak into the cells of the cork to discolor the outer surfaces of the cork stoppers. Where the contents contain alcohol, lignin and suberin which are components of the cork could diffuse to the alcohol, causing the cork stoppers to become "thin", thereby lowering their physical strength and sealing effect.

Also, a container stopper has been proposed in which natural cork or compressed cork is used as the core of the stopper. The liquid-contact surface and the outer peripheral surface continuous with the liquid-contact surface of the cork core are coated with a polyethylene skin. Further, only the liquid-contact portion of the polyethylene skin is coated with a circular sheet made of polyethylene terephthalate (see U.S. Pat. No. 2,973,249, for example).

According to this conventional technique, the above-mentioned problem such as of trichloro-anisole contained in the cork diffusing into the contents is avoided. However, the flavor of the contents could be spoiled by various types of smells entering from outside the container or by absorption or adsorption of the flavor of the contents.

That is, although the liquid-contact surface of the core is coated with a sheet of polyethylene terephthalate, the outer peripheral surface, i.e. the portion that contacts the inner peripheral surface of the opening of the container, is coated with a skin of polyethylene. Since polyethylene is porous and has a property of absorbing and adsorbing smell, when stored in a warehouse, closet or the like, mold smelling substances, typically TCA, present in such an environment, and smell components such as naphthalene contained in an insecticide, could pass between the inner peripheral surface of the opening of the container and the stopper to be absorbed or adsorbed by the polyethylene to adversely affect the taste of the contents with the progress of time. Conversely, the flavor of the contents may be absorbed or adsorbed by the polyethylene, which would adversely affect the taste of the contents. There is room for improvement in this respect.

Naturally, a container stopper, when inserted into the opening of a container, is required to have a function for completely preventing leakage of the contents. However, where only the outer peripheral surface of the core is coated with a skin of polyethylene terephthalate to solve the above-noted problem, a reduction in diameter of the core inserted into the opening of the container results in "creases" being formed on the skin of polyethylene terephthalate covering the peripheries. The "creases" become a cause of leakage of the contents.

This invention has been made having regard to the disadvantages of the prior art noted above, and its object is to provide a container stopper, and a manufacturing method therefor, capable of reliably preventing adverse influences of various smells entering from outside the container and absorption and adsorption of the flavor of the content, as well as preventing adverse influences of a core such as cork.

SUMMARY OF THE INVENTION

The characteristic construction of the first invention lies in a container stopper comprising a core formed of an elastic material and having a liquid-contact surface and an outer peripheral surface continuous with the liquid-contact surface coated with a skin made of a synthetic resin, wherein said skin is a skin made of a polyester resin or a synthetic resin having a polyester resin as a main component thereof, and the skin is bonded to the liquid-contact surface and the outer peripheral surface of said core through a bonding layer.

According to the characteristic construction of the first invention, the liquid-contact surface and the outer peripheral surface continuous with the liquid-contact surface of the core formed of an elastic material are coated with a skin made of a polyester resin or a synthetic resin having a polyester resin as a main component thereof. Even where cork is used as the core, there is of course no possibility of undergoing adverse influences of the core, or adversely affecting the core itself, such as the taste of the contents being spoiled by diffusion of trichloro-anisole contained in the cork. Unlike polyethylene, the polyester resin does not have a property of absorbing or adsorbing smells, and can therefore prevent adverse influences on the contents by entry of various smells from outside the container and absorption and adsorption of the flavor of the contents.

According to the stopper container of this invention, the skin made of a polyester resin or a synthetic resin having a polyester resin as a main component thereof is bonded to the liquid-contact surface and the outer peripheral surface of the core through a bonding layer. The core and the skin made of a polyester resin or a synthetic resin having a polyester resin as a main component thereof are completely integrated. Even if the core reduces in diameter when inserted into the opening of the container, the skin made of a polyester resin or a synthetic resin having a polyester resin as a main component thereof follows the core to shrink alike, thereby avoiding "creases".

As a result, the liquid-contact surface and the outer peripheral surface of the core may be coated with the skin made of a polyester resin or a synthetic resin having a polyester resin as a main component thereof, without impairing the functions required of the container stopper. This prevents adverse influences on the contents by entry of various smells from outside the container and absorption and adsorption of the flavor of the contents, as well as adverse influences of the core, as noted hereinbefore. Even where the content includes alcohol, alcohol barrier characteristics of the polyester resin can prevent diffusion of core components to alcohol, to prevent a volume reduction of the core.

The "synthetic resin having a polyester resin as a main component thereof" herein does not mean that, for example, the polyester resin included is in 50% or more, but means that the polyester resin is included in an amount sufficient for the above-noted functions and effects to be expected. This also applies to the description to follow.

The characteristic construction of the second invention lies in that said skin is a skin made of polyethylene terephthalate.

According to the characteristic construction of the second invention, said skin is a skin made of polyethylene terephthalate. Polyethylene terephthalate has a very high barrier performance, and can further reduce the possibility of adverse influences of the core and adverse influences on the core itself.

The characteristic construction of the third invention lies in that said bonding layer is a polyethylene bonding layer.

According to the characteristic construction of the third invention, said bonding layer is a polyethylene bonding layer, which can bond the core and the skin made of a polyester resin or a synthetic resin having a polyester resin as a main component thereof to be completely integral, and the core and the skin made of polyethylene terephthalate to be completely integral.

The characteristic construction of the fourth invention lies in a container stopper comprising a core formed of an elastic material and having a liquid-contact surface and an outer peripheral surface continuous with the liquid-contact surface coated with a skin made of a synthetic resin, wherein said skin is a skin made of a polyester resin or a synthetic resin having a polyester resin as a main component thereof, and said core is formed of a synthetic resin having elasticity, said skin being bonded to the liquid-contact surface and the outer peripheral surface of the core by thermal adhesion.

According to the characteristic construction of the fourth invention, the liquid-contact surface and the outer peripheral surface continuous with the liquid-contact surface of the core formed of an elastic material are coated with a skin made of a polyester resin or a synthetic resin having a polyester resin as a main component thereof. Thus, as in the first invention described above, adverse influences on the content by entry of various smells from outside the container and absorption and adsorption of the flavor of the contents can be prevented.

The core coated with the skin made of a synthetic resin also is formed of a synthetic resin having elasticity, and the skin made of a synthetic resin is bonded to the liquid-contact surface and the outer peripheral surface of the core by thermal adhesion. Thus, the core and skin having the same components are bonded to be completely integral. Even if the core reduces in diameter when inserted into the opening of the container, the skin shrinks alike, thereby avoiding "creases".

As a result, as in the first invention, the liquid-contact surface and the outer peripheral surface of the core may be coated with the skin made of a polyester resin or a synthetic resin having a polyester resin as a main component thereof, without impairing the functions required of the container stopper. This prevents adverse influences of various smells entering from outside the container and absorption and adsorption of the flavor of the contents, as well as adverse influences of the core. Even where the contents includes alcohol, alcohol barrier characteristics of the polyester resin can prevent diffusion of core components to alcohol, to prevent a volume reduction of the core.

The characteristic construction of the fifth invention lies in that said skin is bonded in a stretched state to said core.

According to the characteristic construction of the fifth invention, said skin is bonded in a stretched state to the core. This prevents "creases" of the skin which tend to occur with a reduction in diameter of the core when inserted into the opening of the container.

That is, a ratio of diameter reduction of the core inserted into the opening of the container may be set beforehand. Depending on the set value, it is not absolutely necessary to bond the skin in a stretched state to the core. However, due to variations in the diameter of the container opening occurring at time of manufacture, the core could reduce in diameter in excess of the set value within the tolerance range.

In this sense, where said skin is bonded in a stretched state to the core, even if the core reduces in diameter in excess of the set value within the tolerance range, the skin shrinks only to an extent restorable to the original state. This improves the performance to follow the core, thereby to avoid "creases" with increased reliability.

The characteristic construction of the sixth invention lies in that part of an outer surface of said skin located on the outer peripheral surface of said core is coated with silicone and/or silicone oil.

According to the characteristic construction of the sixth invention, part of an outer surface of the skin located on the outer peripheral surface of the core is coated with silicone and/or silicone oil. This improves slipping relative to the container opening whereby the container stopper may be extracted from and inserted into the container opening smoothly.

Where, for example, a glass container is used as the container, polyethylene terephthalate tends to fit glass, and an unpleasant sound may be produced at time of extraction and insertion of the container stopper, or the extraction and insertion may be difficult. By coating an appropriate part of the skin made of polyethylene terephthalate with silicone and/or silicone oil, no unpleasant sound may be produced, and the extraction and insertion of the container stopper may be carried out smoothly.

The remaining parts of the outer surface of the skin located on the outer peripheral surface of the core and not coated with silicone and/or silicone oil assure sealing of the container with the core, especially gas barrier performance.

The characteristic construction of the seventh invention lies in that a lubricant is added to said silicone and/or silicone oil.

According to the characteristic construction of the seventh invention, a lubricant is added to said silicone and/or silicone oil. Even where a glass container is used as the container, the extraction and insertion of the container stopper may be carried out smoothly over a long period of time.

That is, by coating part of the skin on the outer peripheral surface of the core with silicone and/or silicone oil, the container stopper is extracted and inserted smoothly as noted above. However, this effect is maintained only over a relatively short period of about several months, for example. After a long period, an affinity could develop between the silicone and/or silicone oil and the glass container to take the smoothness away from the extraction and insertion of the container stopper.

Such a possibility is eliminated by adding a lubricant. The extraction and insertion of the container stopper may be carried out smoothly over a long period of time.

The characteristic construction of the eighth invention lies in that said lubricant is one or more substances selected from fatty acid amides, polyhydric alcohol fatty acid esters and their derivatives, particulate polyethylene lubricants, or silicone particles.

According to the characteristic construction of the eighth invention, said lubricant is one or more substances selected from fatty acid amides, polyhydric alcohol fatty acid esters and their derivatives, particulate polyethylene lubricants, or silicone particles. This reliably prevents an affinity from developing between the silicone and/or silicone oil and the glass container to assure smooth extraction and insertion of the container stopper over a long period of time.

The characteristic construction of the ninth invention lies in that the part of the outer surface of said skin located on the outer peripheral surface of said core and coated with said silicone and/or silicone oil is surface-treated.

According to the characteristic construction of the ninth invention, the part of the outer surface of the skin located on the outer peripheral surface of said core and coated with the silicone and/or silicone oil is surface-treated. Thus, the outer surface of the skin may be coated with the silicone and/or silicone oil easily and reliably.

The characteristic feature of the tenth invention lies in a method of manufacturing a container stopper comprising a core formed of an elastic material and having a liquid-contact surface and an outer peripheral surface continuous with the liquid-contact surface coated with a skin made of a synthetic resin, wherein a film of a polyester resin or a synthetic resin having a polyester resin as a main component thereof is used as said skin, the resin film is stretched, and said core is press-fit in a heated state for extension, the resin film and the liquid-contact surface and the outer peripheral surface of said core being bonded through a bonding layer.

According to the characteristic feature of the tenth invention, a synthetic resin film of a polyester resin or a synthetic resin having a polyester resin as a main component thereof is used as the skin for coating the liquid-contact surface and the outer peripheral surface continuous with the liquid-contact surface of the core formed of an elastic material. The resin film is stretched, and the core is press-fit in a heated state for extension. The film of a polyester resin or a synthetic resin having a polyester resin as a main component thereof is coated in contact with and firmly on the liquid-contact surface and outer peripheral surface of the core.

In this state, the synthetic resin film of a polyester resin or a synthetic resin having a polyester resin as a main component thereof and the liquid-contact surface and outer peripheral surface of the core are bonded through a bonding layer. Thus, to manufacture the container stopper noted hereinbefore, the core and the skin made of a polyester resin or a synthetic resin having a polyester resin as a main component thereof are completely integrated.

The characteristic feature of the eleventh invention lies in that a synthetic resin film of a polyester resin or a synthetic resin having a polyester resin as a main component thereof and having a skin-side adhesion forming layer bonded to an inner surface thereof is used as said skin, and a core having a core-side adhesion forming layer bonded to a liquid-contact surface and an outer peripheral surface thereof is used as said core, said skin-side and core-side adhesion forming layers being integrated by thermal fusion to form said bonding layer.

According to the characteristic feature of the eleventh invention, a synthetic resin film of a polyester resin or a synthetic resin having a polyester resin as a main component thereof and having a skin-side adhesion forming layer bonded to an inner surface thereof is used as said skin, and a core having a core-side adhesion forming layer bonded to a liquid-contact surface and an outer peripheral surface thereof is used as the core, said skin-side and core-side adhesion forming layers being integrated by thermal fusion to form the bonding layer. This provides a bonding with increased reliability between the core and the synthetic resin film of a polyester resin or a synthetic resin having a polyester resin as a main component thereof.

Where natural cork or compressed cork is used as the core, a polyester resin does not necessarily have good adhesion to the cork. By bonding adhesion forming layers to the cork core and the synthetic resin film of a polyester resin or a synthetic resin having a polyester resin as a main component thereof beforehand, and integrating the two adhesion forming layers by thermal fusion, even where the core is formed of cork, the core and the synthetic resin film of a polyester resin or a synthetic resin having a polyester resin as a main component thereof are bonded reliably.

The characteristic feature of the twelfth invention lies in that said skin-side and core-side adhesion forming layers are polyethylene layers.

According to the characteristic feature of the twelfth invention, said skin-side and core-side adhesion forming layers are polyethylene layers. It is therefore possible that the core and the synthetic resin film of a polyester resin or a synthetic resin having a polyester resin as a main component thereof are bonded to be completely integral.

The characteristic feature of the thirteenth invention lies in that a synthetic resin film of a polyester resin or a synthetic resin having a polyester resin as a main component thereof and having a skin-side adhesion forming layer of polyethylene bonded to an inner surface thereof by a dry laminate method is used as said skin.

According to the characteristic feature of the thirteenth invention, a synthetic resin film of a polyester resin or a synthetic resin having a polyester resin as a main component thereof and having a skin-side adhesion forming layer of polyethylene bonded to an inner surface thereof by a dry laminate method is used as said skin. The synthetic resin film and the skin-side adhesion forming layer are bonded reliably and firmly. As a result, the synthetic resin film and the core are bonded reliably and firmly.

DETAILED DESCRIPTION OF THE INVENTION

An embodiment of this invention regarding container stoppers and a manufacturing method therefor will be described with reference to the drawings.

Figure 1:
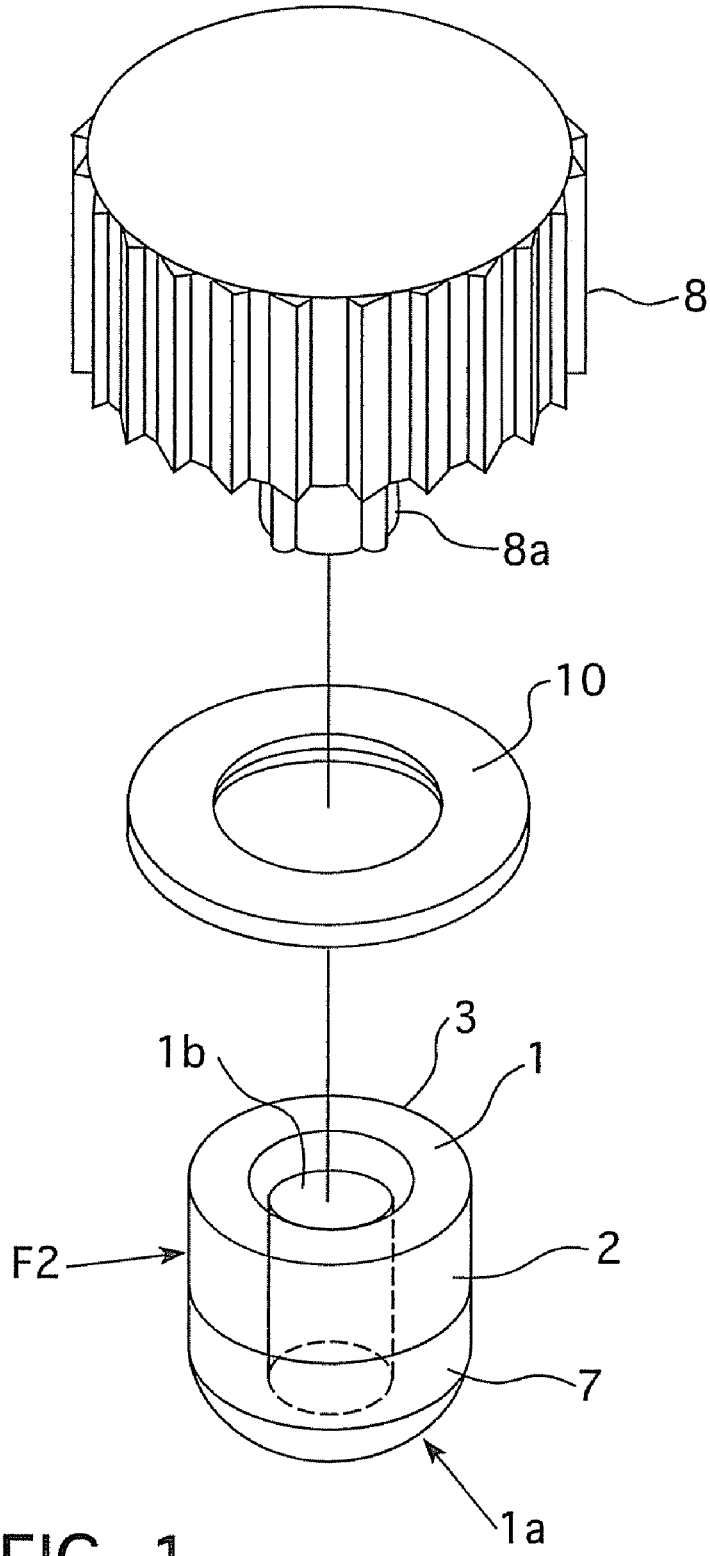
FIG. 1 is an exploded perspective view of a stopper for whiskey.
Figure 2:
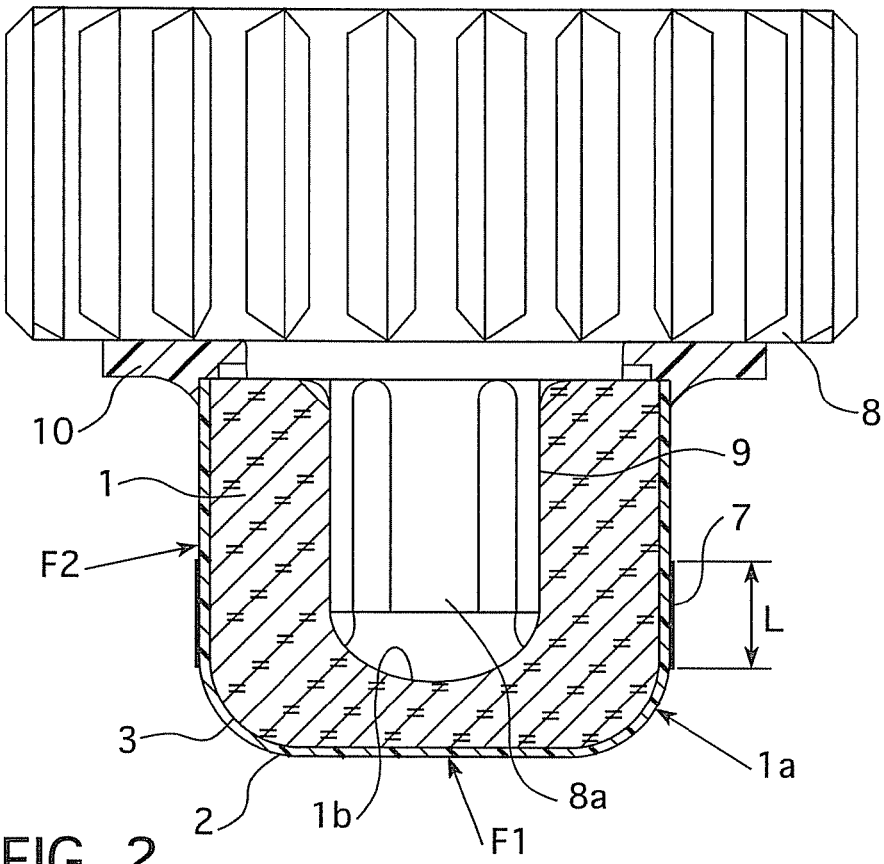
FIG. 2 is a view, partly in section, of the stopper for whiskey.

Container stoppers of this invention are intended for closing openings of glass or ceramic containers containing liquids including various alcoholic drinks such as whiskey and wine, and other drinks and cosmetics. A stopper for whiskey, as shown in FIGS. 1 and 2, for example, includes a circular core 1 section formed of natural cork or compressed cork which is an example of elastic materials, and having a chamfer 1*a* at a tip portion and an inner mounting hole 1*b*. A liquid-contact surface F1 and an outer peripheral surface F2 continuous with the liquid-contact surface F1 of the core 1 are coated with a skin 2 of polyethylene terephthalate (PET), which is an example of polyester resins, having a thickness of about 1-200 micrometers.

As the skin 2 for coating the core 1, the polyethylene terephthalate used, preferably, is an amorphous, relatively flexible polyethylene terephthalate treated against crystallization by copolymerization with a third component such as 1,4-cyclohexane dimethanol or isophthalic acid. The skin 2 of polyethylene terephthalate is bonded all over the liquid-contact surface F1 and outer peripheral surface F2 of the core 1 through a bonding layer 3.

Figure 3:
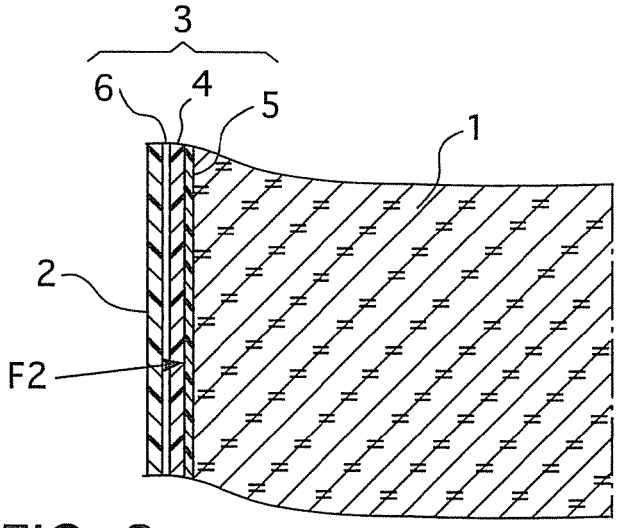
FIG. 3 is an enlarged sectional view of a principal portion of the stopper for whiskey.

As shown in FIG. 3, the bonding layer 3 mainly comprises a polyethylene layer, and the polyethylene layer includes a polyethylene adhesive film 5 and a polyethylene film 4 arranged in order from adjacent the core 1. A urethane adhesive 6 is interposed between the polyethylene film 4 and the skin 2 of polyethylene terephthalate.

Further, except a portion of the skin 2 of polyethylene terephthalate, i.e. a portion of the skin 2 located on the outer peripheral surface F2 of the core 1, specifically the portion on the chamfer la, the outer surface of the tip portion of the core 1 is coated with silicone 7 over a width indicated by "L" in FIG. 2, in order to be smoothly slidable relative to the opening of a container not shown.

The coating of silicone 7 on the skin 2 of polyethylene terephthalate may easily be formed by applying the silicone 7 after surface treatment by corona treatment or plasma treatment of the surface of the skin 2 of polyethylene terephthalate. In this case, it is more desirable to add and apply a lubricant to the silicone 7 than to apply the silicone 7 alone.

The lubricant added, preferably, is one or more substances selected from fatty acid amides, polyhydric alcohol fatty acid esters and their derivatives, particulate polyethylene lubricants, or silicone particles. The fatty acid amides include, for example, oleic acid amide, erucic acid amide, behenic acid amide, stearic acid amide and so on. The polyhydric alcohol fatty acid esters and their derivatives include, for example, sorbitan monooleate, sorbitan monostearate, sorbitan trioleate and so on.

The stopper for whiskey is formed by inserting a projection 8*a* projecting from a glass umbrella 8 into the mounting hole 1*b* of the core 1, attaching the glass umbrella 8 to the upper end of the core 1 by an adhesive 9, and covering the contact portion of the upper end of the core 1 and the undersurface of the glass umbrella 8 with a washer seal 10 made of a synthetic resin.

Figure 4:
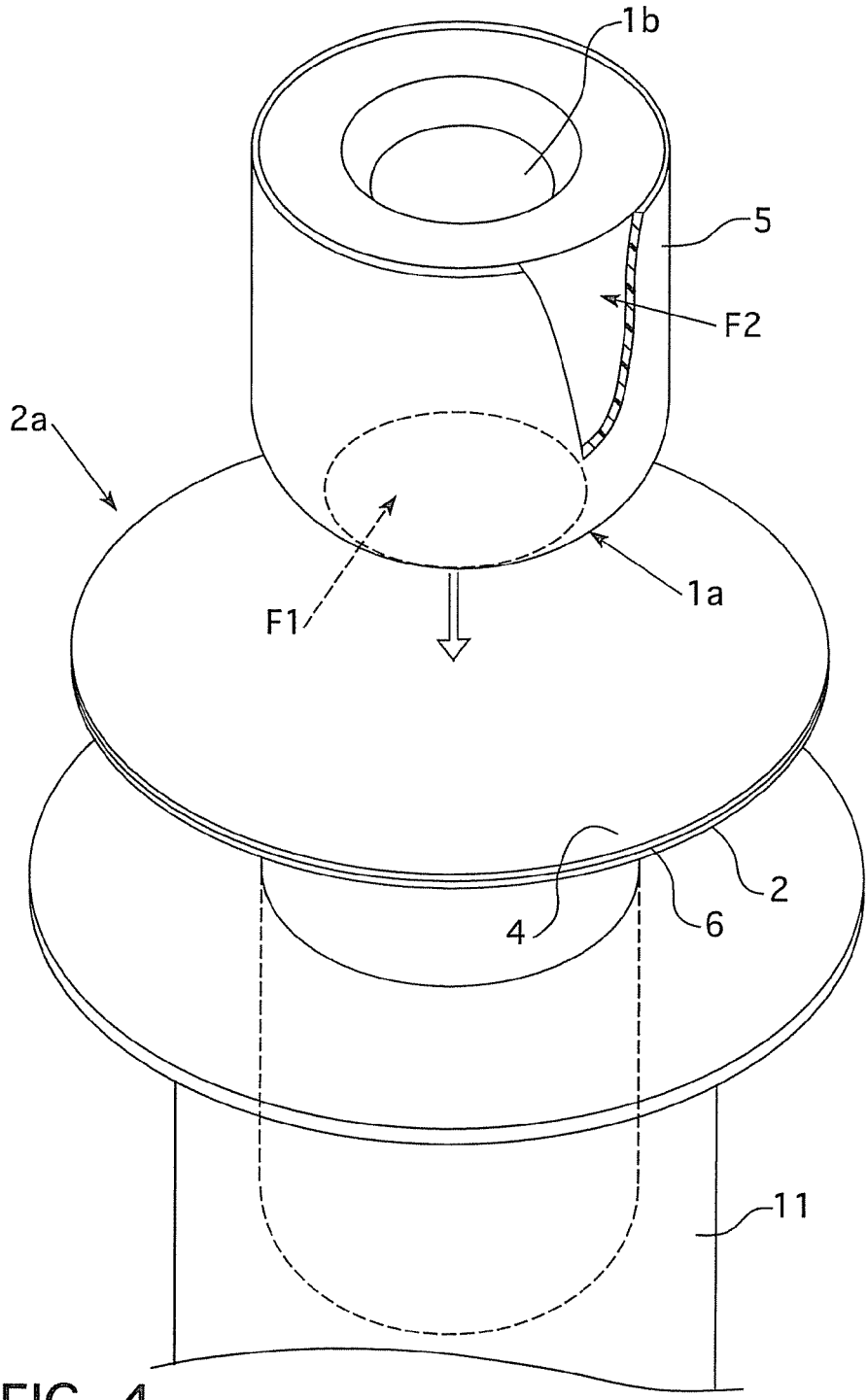
FIG. 4 is a perspective view, partly cut away, showing a process of manufacturing the stopper for whiskey.

To manufacture such a stopper for whiskey, as shown in FIG. 4, a film 2*a* of polyethylene terephthalate is used as the skin 2 of polyethylene terephthalate. The polyethylene film 4 is bonded as the polyethylene layer to the inner surface of the film 2*a* of polyethylene terephthalate with the urethane adhesive 6 by a dry laminate method beforehand. Similarly, the polyethylene adhesive film 5 is also bonded by thermal fusion to the liquid-contact surface F1 and outer peripheral surface F2 of the core 1 beforehand.

Next the film 2*a* of polyethylene terephthalate is stretched, pressed down at peripheries thereof, and placed in a heated state over the core 1, and the core 1 is pressed into a die 11 of smaller diameter than the outside diameter of the core 1.

Subsequently, when the core 1 is taken out of the die, the core 1 restores to its original state whereby the film 2*a* of polyethylene terephthalate is fitted in the stretched state over the core 1. Thereafter thermal fusion is made between the polyethylene adhesive film 5 which acts as a core-side adhesion forming layer of the core 1 and the polyethylene film 4 which acts as a film-side adhesion forming layer of the film 2*a* of polyethylene terephthalate.

Figure 5:
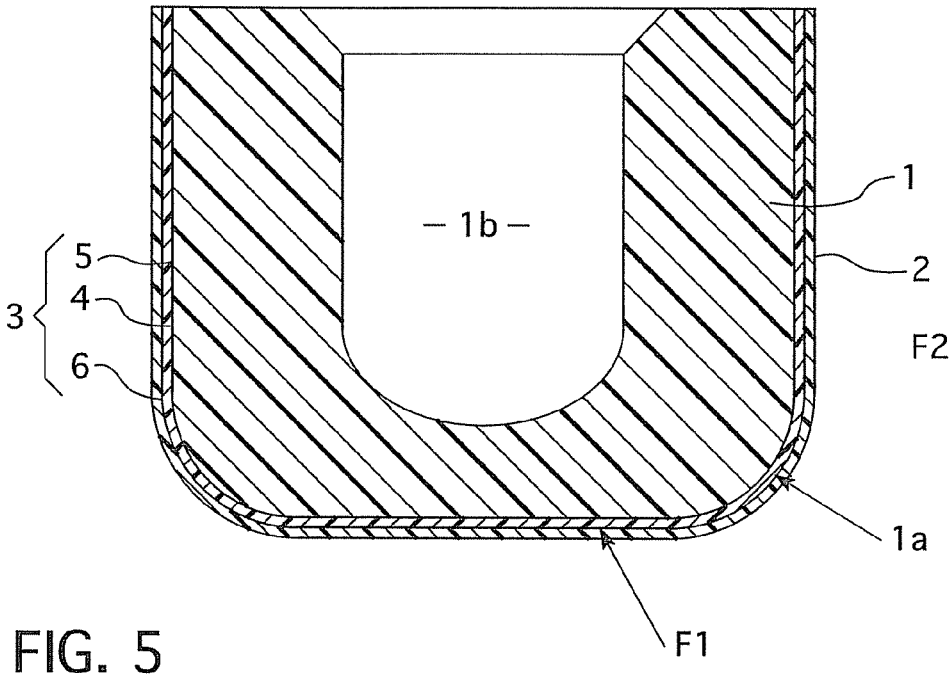
FIG. 5 is a sectional view showing the process of manufacturing the stopper for whiskey.

Then, the polyethylene adhesive film 5 and the polyethylene film 4 are integrated by the thermal fusion. As shown in FIG. 5, the skin 2 of polyethylene terephthalate is firmly bonded all over the liquid-contact surface F1 and outer peripheral surface F2 of the core 1. Subsequently, as noted above, the outer surface of the tip portion of the core 1 is coated with the silicone 7, and the glass umbrella 8 and washer seal 10 are attached to the core 1. The core 1 shown in FIG. 5 is made of a synthetic resin having elasticity.

Although not shown, with the stopper for whiskey shown in FIG. 5, the inner peripheral surface and upper surface of the mounting hole 1*b* may also be completely coated with the skin 2 of polyethylene terephthalate. In this case, the core 1 will be completely sealed off from the exterior to eliminate adverse influences of the core 1 on the contents.

Figure 6:
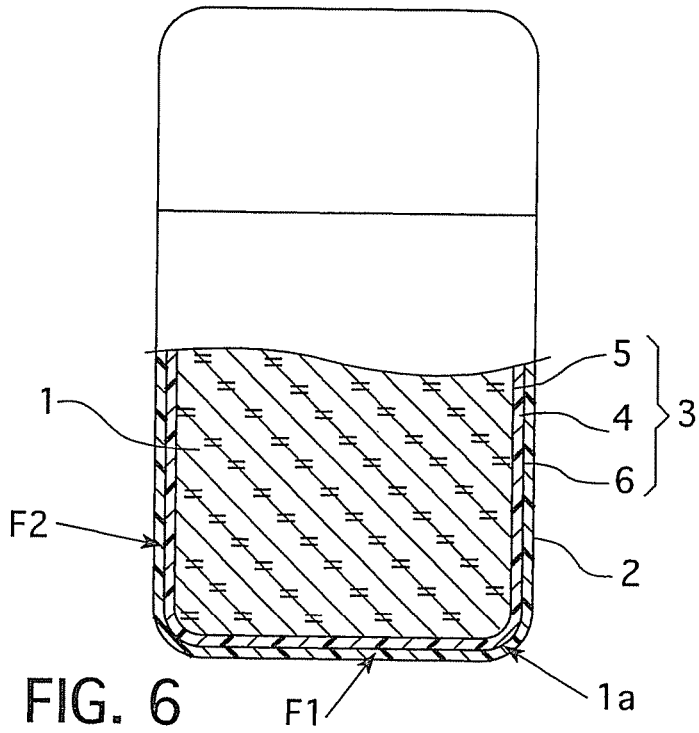
FIG. 6 is a view, partly in section, of a stopper for wine.
Figure 7:
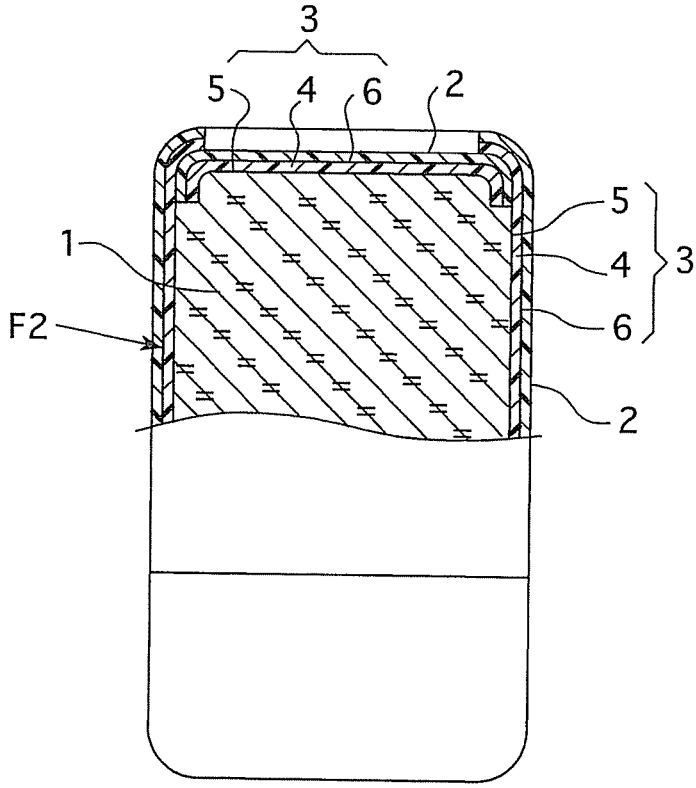
FIG. 7 is a view, partly in section, of the stopper for wine.

While the stopper for whiskey has been described above, the same applies to other stoppers. In the case of a stopper for wine, as shown in FIGS. 6 and 7, a solid circular core 1 section having a chamfer 1*a* at a tip end portion thereof is formed of natural cork or compressed cork. The core 1 includes a liquid-contact surface F1 and an outer peripheral surface F2 continuous with the liquid-contact surface F1 which are coated all over with a skin 2 of polyethylene terephthalate having a thickness of about 1-200 micrometers. The skin 2 may have a coating boundary adjacent the center of the core 1 as shown in FIG. 6, or may have a coating boundary at an end of the core 1 as shown in FIG. 7.

What is preferred as the skin 2 is an amorphous, relatively flexible polyethylene terephthalate treated against crystallization by copolymerization with a third component such as 1,4-cyclohexane dimethanol or isophthalic acid. As in the stopper for whiskey described hereinbefore, the skin 2 of polyethylene terephthalate is bonded all over the core 1 through a bonding layer 3 mainly comprising a polyethylene layer.

The manufacture of the stopper for wine is the same as the manufacture of the stopper for whiskey described above, and a detailed description will not be made to avoid tautology. A film of polyethylene terephthalate with a polyethylene film bonded to the inner surface thereof, and a core 1 with a polyethylene sheet bonded to the entire outer surface thereof, are used. The film of polyethylene terephthalate is stretched, pressed down at peripheries thereof, and placed in a heated state over the core 1, and the core 1 is pressed into a die of smaller diameter than the core 1.

As a result, the film of polyethylene terephthalate is fitted in the stretched state over the core 1. The polyethylene adhesive film 5 on the core 1 and the polyethylene film 4 on the film of polyethylene terephthalate are integrated by thermal fusion to form the bonding layer 3. The skin 2 of polyethylene terephthalate is bonded all over the core 1.

Further, the stopper for wine usually is not something that is repeatedly pulled out of and put into the opening of the container. The embodiment shown in FIGS. 6 and 7 does not include the skin of silicone 7 provided for the stopper for whiskey.

Other Embodiments (1) In the foregoing embodiment, the core 1 is formed of natural cork or compressed cork. Apart from cork, various elastic materials having appropriate elasticity required for the core of a stopper for a container may be used, which include natural rubber, synthetic rubber, molding of wood chips, a polyester resin, and a synthetic resin having a polyester resin as a main component thereof.

Regarding the skin 2 for coating the core 1, an example is shown as being formed of polyethylene terephthalate which is one example of polyester resins. Apart from this, polybutylene terephthalate, polyester resins such as thermoplastic polyester elastomer, and various synthetic resins having polyester resins as main components thereof, may be used.

The bonding layer 3 is shown to comprise mainly a polyethylene layer. Apart from this, the bonding layer may be formed, for example, of polyolefine, TPO, TPEE, TPU, and so on.

(2) In the foregoing embodiment, for bonding the core 1 and the skin 2 of polyethylene terephthalate, the polyethylene adhesive film 5 and polyethylene film 4 are bonded to the core 1 and skin 2 beforehand, and the polyethylene adhesive film 5 and polyethylene film 4 are integrated by thermal fusion to form the bonding layer 3. The bonding layer 3 may be formed by methods other than thermal fusion. Where the polyethylene adhesive film 5 and polyethylene film 4 are bonded beforehand, the adhesive used may be, apart from the polyethylene or urethane adhesive, various adhesives such as a polyester adhesive, a silicone adhesive and an epoxy phenol adhesive, for example.

(3) In the foregoing embodiment, an example is shown in which silicone 7 is used in the stopper for whiskey, and silicone 7 is not used in the stopper for wine. Instead, silicone 7 may not be used in the stopper for whiskey, and silicone 7 may be used in the stopper for wine.

In any case, where the silicone 7 is used, the silicone 7 may be replaced with silicone oil, or the silicone 7 and silicone oil may be blended for use.

The container stoppers and the manufacturing method therefor according to this invention are applicable as container stoppers for closing openings of glass or ceramic containers containing various alcoholic drinks such as whiskey and wine, various non-alcoholic drinks, and various liquids such as cosmetics, and as methods of manufacturing the container stoppers.

The invention claimed is:

1. A container stopper comprising a core formed of an elastic material and having a liquid-contact surface and an outer peripheral surface continuous with the liquid-contact surface, both the liquid-contact surface and the outer peripheral surface being coated with a skin made of a synthetic resin, wherein said skin is a skin made of a polyester resin or a synthetic resin having a polyester resin as a main component thereof, said skin being bonded to said core via a bonding layer;

said bonding layer includes a core-side adhesion forming layer bonded to the liquid-contact surface and the outer peripheral surface and a skin-side adhesion forming layer bonded to the skin; and said skin is bonded to the core by thermal fusion of the core-side adhesion forming layer and the skin-side adhesion forming layer.

2. The container stopper as defined in claim 1, wherein said skin is a skin made of polyethylene terephthalate.

3. The container stopper as defined in claim 1, wherein both said skin-side adhesion forming layer and said core-side adhesion forming layer are polyethylene bonding layers.

4. The container stopper as defined in claim 1, wherein said core is formed of a synthetic resin.

5. The container stopper as defined in claim 1, wherein said skin is bonded in a stretched state to said core and said skin maintains this stretched state after its bonding to the core.

6. The container stopper as defined in claim 5, wherein part of an outer surface of said skin located on the outer peripheral surface of said core is coated with at least one of silicone and silicone oil.

7. The container stopper as defined in claim 6, wherein a lubricant is added to said at least one of silicone and silicone oil.

8. The container stopper as defined in claim 7, wherein said lubricant is at least one of substances selected from fatty acid amides, polyhydric alcohol fatty acid esters and their derivatives, particulate polyethylene lubricants, and silicone particles.

9. The container stopper as defined in claim 6, wherein the part of the outer surface of said skin located on the outer peripheral surface of said core and coated with said at least one of silicone and silicone oil is surface-treated.

10. The container stopper as defined in claim 2, wherein said skin is bonded in a stretched state to said core and said skin maintains this stretched state after its bonding to the core.

11. The container stopper as defined in claim 3, wherein said skin is bonded in a stretched state to said core and said skin maintains this stretched state after its bonding to the core.

12. The container stopper as defined in claim 4, wherein said skin is bonded in a stretched state to said core and said skin maintains this stretched state after its bonding to the core.

13. The container stopper as defined in claim 1, wherein said skin is a polyethylene terephthalate skin formed as a copolymer with 1,4-cyclohexane dimethanol or isophthalic acid.

14. The container stopper as defined in claim 13, wherein said skin is bonded in a stretched state to said core and said skin maintains this stretched state after its bonding to the core.

* * * * *